US010865976B2

(12) United States Patent
Lee et al.

(10) Patent No.: US 10,865,976 B2
(45) Date of Patent: Dec. 15, 2020

(54) LIGHT-EMITTING DIODE DRIVER WITH WIRELESS DEVICE FUNCTION

(71) Applicant: Delta Electronics, Inc., Taoyuan (TW)

(72) Inventors: Jui-Ching Lee, Taoyuan (TW); Po-Heng Chao, Taoyuan (TW); Ching-Ho Chou, Taoyuan (TW)

(73) Assignee: DELTA ELECTRONICS, INC., Tao Yu An (TW)

( * ) Notice: Subject to any disclaimer, the term of this patent is extended or adjusted under 35 U.S.C. 154(b) by 0 days.

(21) Appl. No.: 16/548,083

(22) Filed: Aug. 22, 2019

(65) Prior Publication Data

US 2020/0318824 A1 Oct. 8, 2020

(30) Foreign Application Priority Data

Apr. 2, 2019 (CN) ..... 2019 1 0262350

(51) Int. Cl.
*F21V 29/76* (2015.01)
*F21V 19/00* (2006.01)
*H05B 45/00* (2020.01)

(52) U.S. Cl.
CPC ..... *F21V 29/76* (2015.01); *F21V 19/0015* (2013.01); *H05B 45/00* (2020.01)

(58) Field of Classification Search
CPC ..... F21V 29/76; F21V 19/0015
USPC ..... 362/364
See application file for complete search history.

(56) References Cited

U.S. PATENT DOCUMENTS 4,800,475 A * 1/1989 Panagiotou ..... F21V 29/004 362/294
2005/0190553 A1* 9/2005 Lynch ..... F21V 29/76 362/227
2010/0097780 A1* 4/2010 Beatenbough ..... F21V 29/89 362/92
2012/0281432 A1* 11/2012 Parker ..... G02B 6/0031 362/609
2013/0329436 A1* 12/2013 Suzuki ..... F21V 17/16 362/311.02
2014/0063803 A1* 3/2014 Yaphe ..... F21V 15/013 362/247
2017/0234490 A1* 8/2017 Dahlen ..... F21V 29/76 362/294
2017/0261164 A1* 9/2017 Ogata ..... H05B 45/10
2018/0058679 A1* 3/2018 Majerczyk ..... F21V 3/00
2018/0314001 A1* 11/2018 Veenstra ..... A47F 3/001

* cited by examiner

*Primary Examiner* — Bryon T Gyllstrom
(74) *Attorney, Agent, or Firm* — Muncy, Geissler, Olds & Lowe, P.C.

(57) ABSTRACT

A light-emitting diode driver is provided, including a housing, a plate, a wireless coil, and at least one electronic member. An opening is formed on a lateral wall of the housing. The plate is detachably connected to the housing, so as to cover the opening. The plate includes a first side, a first guiding slot formed on the first side, a second side opposite the first side, a second guiding slot formed on the second side, and a bottom side adjacent to a bottom plate of the housing. At least a portion of the lateral wall is accommodated in the first and second guiding slots. The wireless coil is disposed in the housing and adjacent to the plate. The electronic member is disposed in the housing and electrically connected to the wireless coil. The housing and the plate are respectively made of metal and non-metal materials.

11 Claims, 11 Drawing Sheets

E

LIGHT-EMITTING DIODE DRIVER WITH WIRELESS DEVICE FUNCTION

CROSS REFERENCE TO RELATED APPLICATIONS

This application claims the benefit of China Patent Application No. 201910262350.8, filed Apr. 2, 2019, the entirety of which is incorporated by reference herein.

BACKGROUND OF THE INVENTION

Field of the Invention

The application relates in general to a light-emitting diode driver, and in particular, to a light-emitting diode driver having a wireless coil.

Description of the Related Art

Generally, an opening or a cutting should be made on a metal housing of a light-emitting diode (LEO) driver with a wireless function in a position corresponding to a wireless coil, so that the wireless coil can transmit signals through the manufactured hole.

However, after manufacturing the hole, the strength of the metal housing of the light-emitting diode driver may be reduced, and the foreign object may enter the inner portion of the light-emitting diode driver through the hole. Some light-emitting diode drivers include non-metal members attached to the hole to serve as a cover, but the non-metal member can be easily separated. In addition, it is hard to assemble or manufacture the aforementioned non-metal member. Thus, how to address the aforementioned problem has become an important issue.

BRIEF SUMMARY OF INVENTION

To address the deficiencies of conventional products, an embodiment of the invention provides a light-emitting diode driver, including a housing, a plate, a wireless coil, and at least one electronic member. The housing includes a lateral wall and a bottom plate connected to each other, and an opening is formed on the lateral wall. The plate is detachably connected to the housing, so as to cover the opening. The plate includes a first side, a first guiding slot, a second side, a second guiding slot, and a bottom side. The first side is opposite the second side, the first guiding slot and the second guiding slot are respectively formed on the first side and the second side, and the bottom side is adjacent to the bottom plate. At least a portion of the lateral wall is accommodated in the first and second guiding slots. The wireless coil is disposed in the housing and adjacent to the plate. The electronic member is disposed in the housing and electrically connected to the wireless coil. The housing and the plate are respectively made of metal and non-metal materials.

In some embodiments, the plate further comprises a third guiding slot. The third guiding slot is formed on the bottom side and communicates with the first guiding slot and the second guiding slot. When the plate is connected to the housing, a portion of the lateral wall is accommodated in the third guiding slot.

In some embodiments, the light-emitting diode driver further comprises a cover and a wire, and the plate further comprises a through hole. The cover is detachably connected to the lateral wall of the housing, and the wireless coil and the electronic member are disposed between the cover and the bottom plate. The wire passes through the through hole and connects the wireless coil or the electronic member. The cover comprises an extending portion extended toward the bottom plate, and the plate is disposed between the extending portion and the wireless coil. The extending portion has a round corner adjacent to the wire.

In some embodiments, the opening and the lateral wall have a cross-sectional area, and the area of the opening occupies 80% of the cross-sectional area. The dimensions of the plate are substantially the same as the dimensions of the opening. The lateral wall has a first end and a second end, the first end is connected to the bottom plate, and the second end is opposite the first end, wherein the distance between the bottom side and the second end is less than ⅙ of the distance between the first end and the second end.

In some embodiments, the plate does not protrude from the second end of the lateral wall.

BRIEF DESCRIPTION OF DRAWINGS

The invention can be more fully understood by reading the subsequent detailed description and examples with references made to the accompanying drawings, wherein.

DETAILED DESCRIPTION OF INVENTION

The making and using of the embodiments of the light-emitting diode driver are discussed in detail below. It should be appreciated, however, that the embodiments provide many applicable inventive concepts that can be embodied in a wide variety of specific contexts. The specific embodiments discussed are merely illustrative of specific ways to make and use the embodiments, and do not limit the scope of the disclosure.

Unless defined otherwise, all technical and scientific terms used herein have the same meaning as commonly understood by one of ordinary skill in the art to which this invention belongs. It should be appreciated that each term, which is defined in a commonly used dictionary, should be interpreted as having a meaning conforming to the relative skills and the background or the context of the present disclosure, and should not be interpreted in an idealized or overly formal manner unless defined otherwise.

Figure 1:
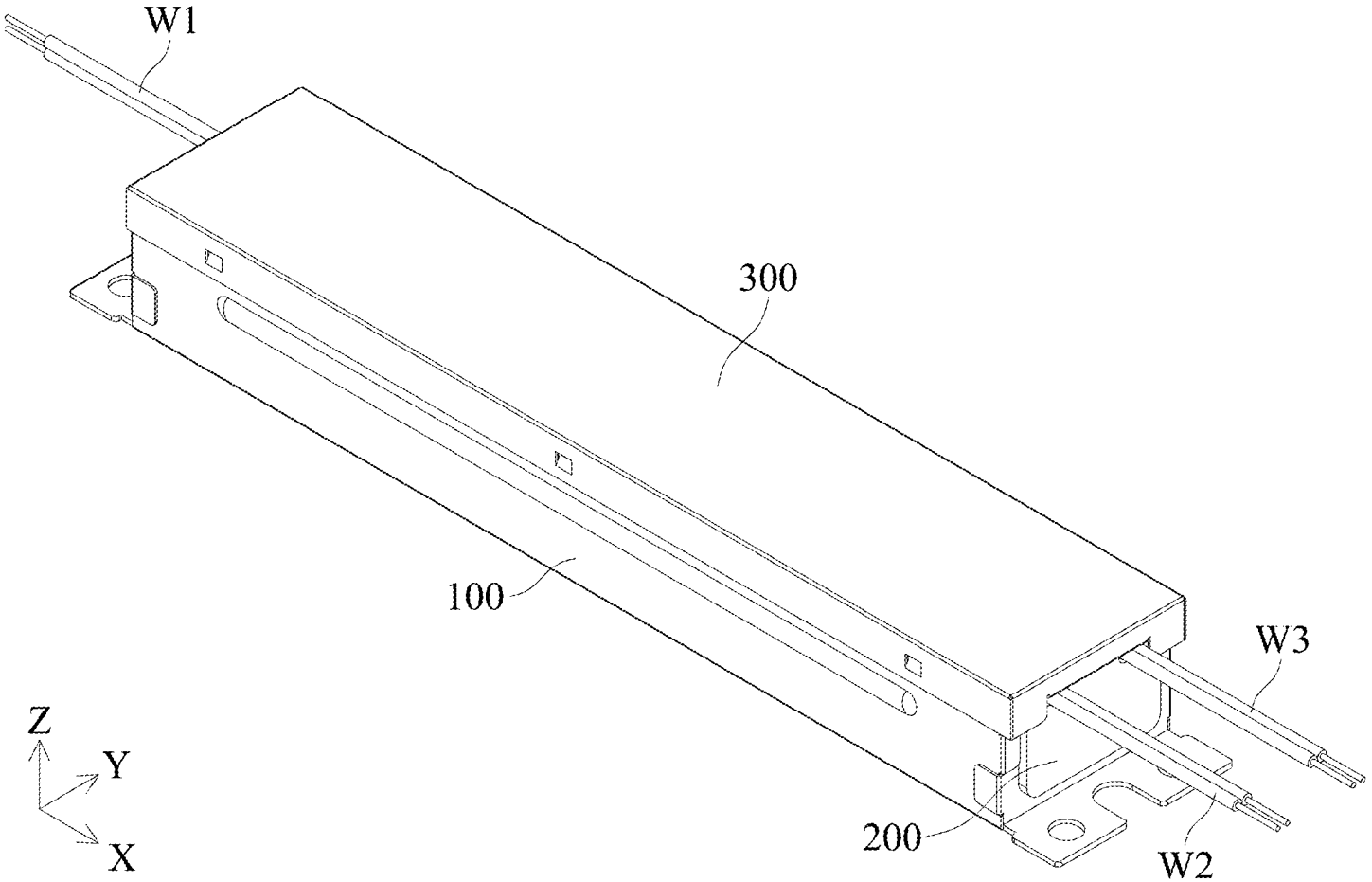
FIG. 1 is a schematic diagram of a light-emitting diode driver according to an embodiment of the invention.

FIG. 1 is a schematic diagram of a light-emitting diode driver E according to an embodiment of the invention. The aforementioned light-emitting diode driver E can connect a light-emitting diode module to a power device (such as a power supply or an electric socket), so as to change the voltage of the power from the power device and provide the power to the light-emitting diode module. Furthermore, the light-emitting diode module E can also transmit a control signal to the light-emitting diode module.

Figure 2:
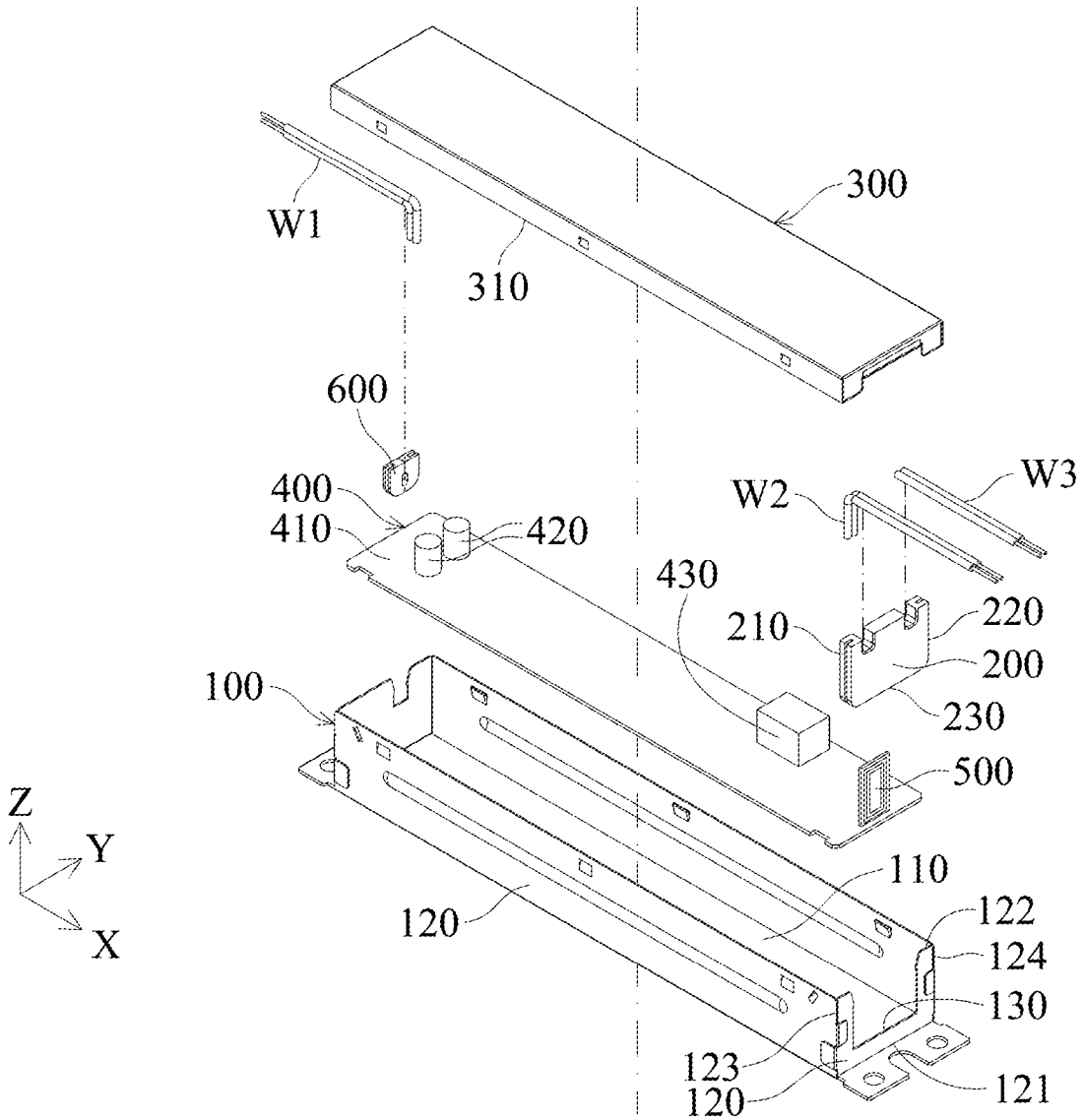
FIG. 2 is an exploded-view diagram of the light-emitting diode driver according to an embodiment of the invention.

FIG. 1 is an exploded-view diagram of the light-emitting diode driver E. Referring to FIGS. 1 and 2, the light-emitting diode driver E primarily includes a housing 100, a plate 200, a cover 300, at least one electronic member 400, a wireless coil 500, a wire protecting ring 600, and at least one wire (in this embodiment, the light-emitting diode driver E includes wires W1, W2, and W3).

The housing 100 includes a bottom plate 110 and a plurality of lateral walls 120. The bottom plate 110 substantially has a rectangular structure. The lateral walls 120 are connected to the bottom plate 110 at the four sides of the rectangular structure and extended toward the Z-axis, so as to form an accommodating space. The electronic member 400 and the wireless coil 500 can be accommodated in the accommodating space.

Figure 3:
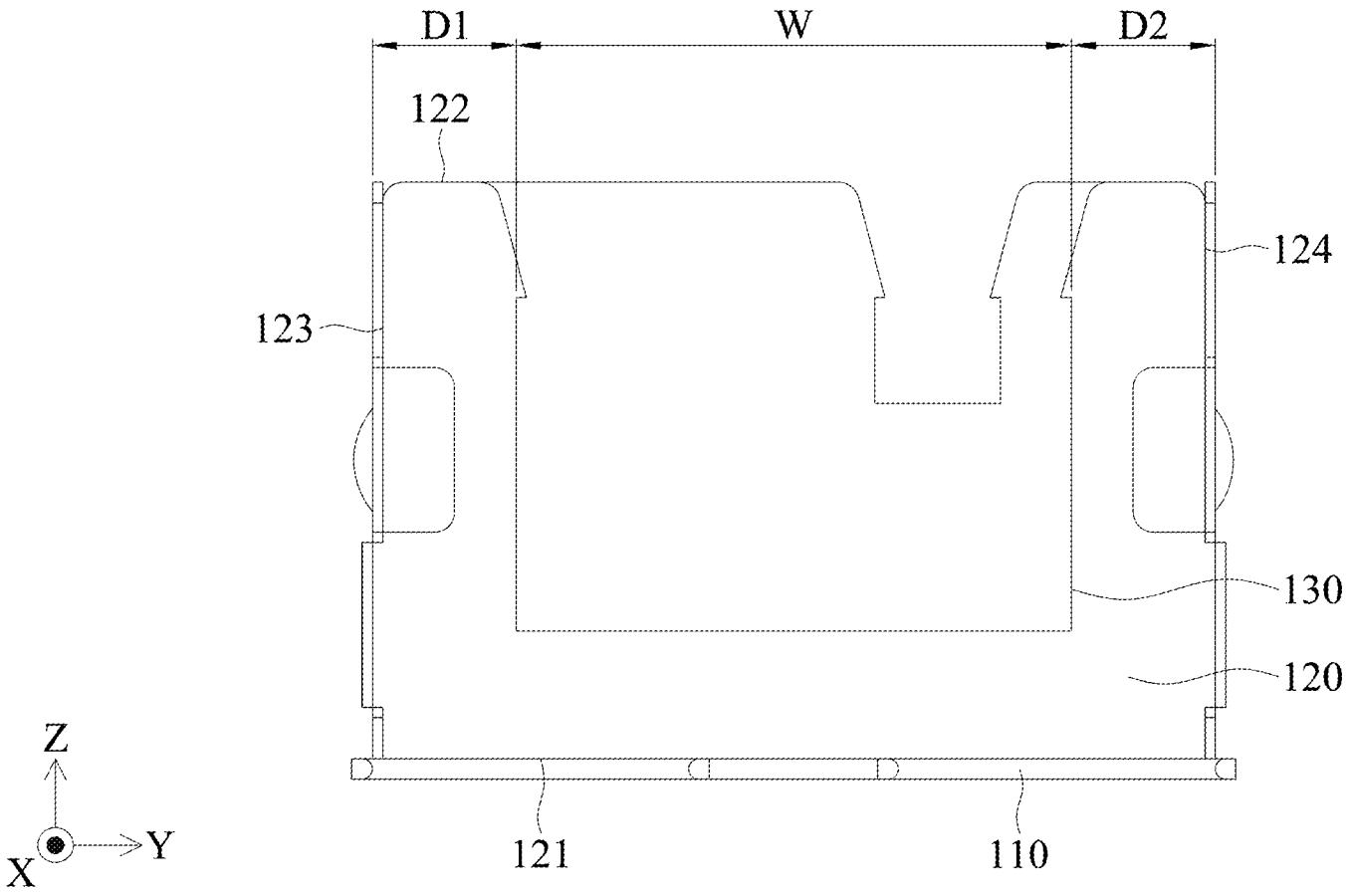
FIG. 3 is a schematic diagram of a housing according to an embodiment of the invention.

Each of the lateral walls 120 of the housing 100 has a first end 121, a second end 122, a third end 123, and a fourth end 124, wherein the first end 121 is opposite the second end 122, and the third end 123 is opposite the fourth end 124. The first end 121 is connected to the bottom plate 110 of the housing 100, and the third end 123 and the fourth end 124 are connected to the other lateral walls 120. As shown in FIGS. 2 and 3, an opening 130 is formed on one of the lateral walls 120. The opening 130 is communicated with the accommodating space and connected to the second end 122. In this embodiment, the lateral wall 120 having the opening 130 has a cross-sectional area on the YZ-plane, and the area of the opening 130 occupies 80% of the cross-sectional area. Moreover, the distance D1 between the opening 130 and the third end 123 is substantially the same as the distance D2 between the opening 130 and the fourth end 124 (for example, the ratio of the width W of the opening 130 and the distance D1 can be 8:1).

Figure 4:
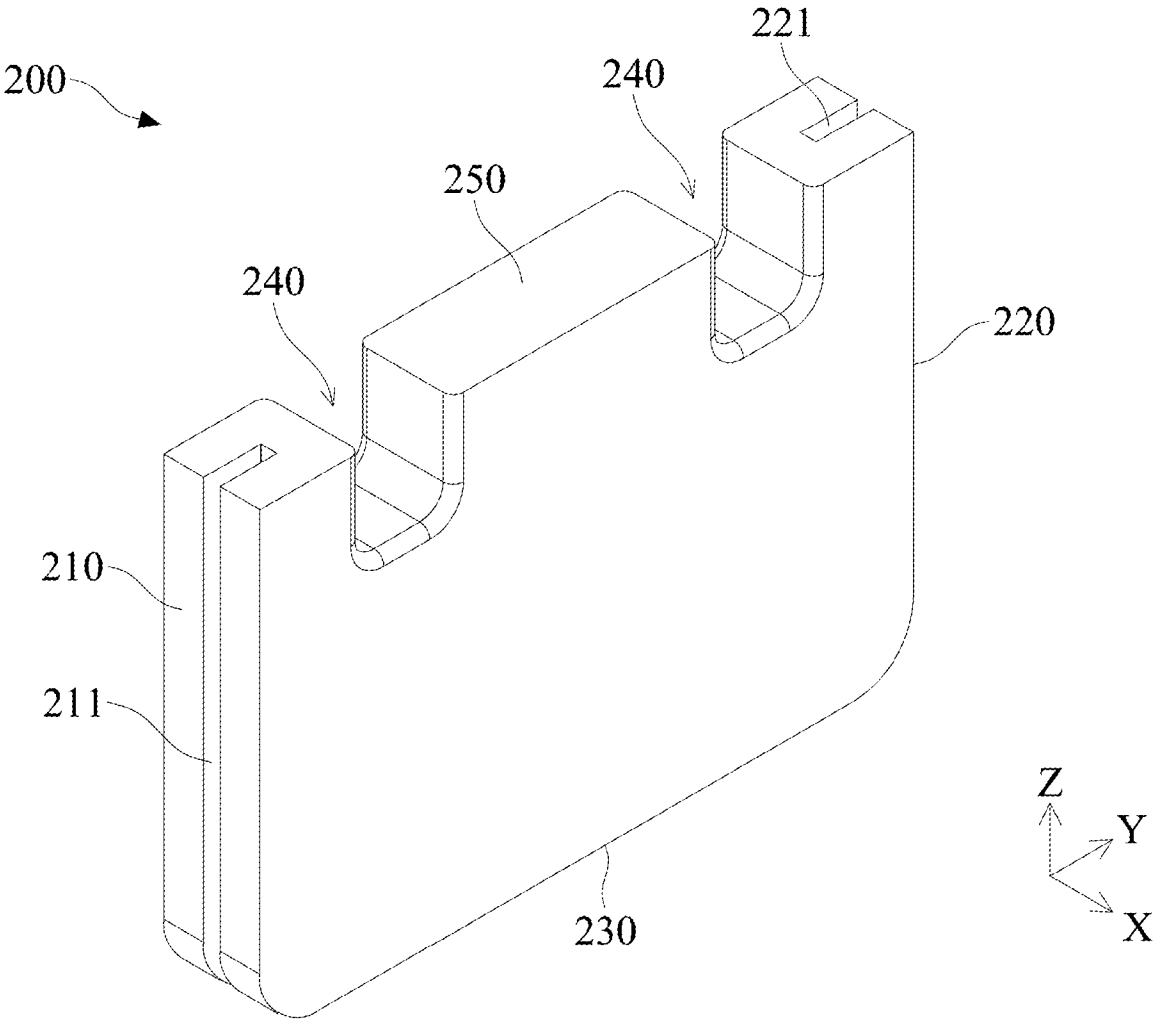
FIG. 4 is a schematic diagram of a plate according to an embodiment of the invention.
Figure 5:
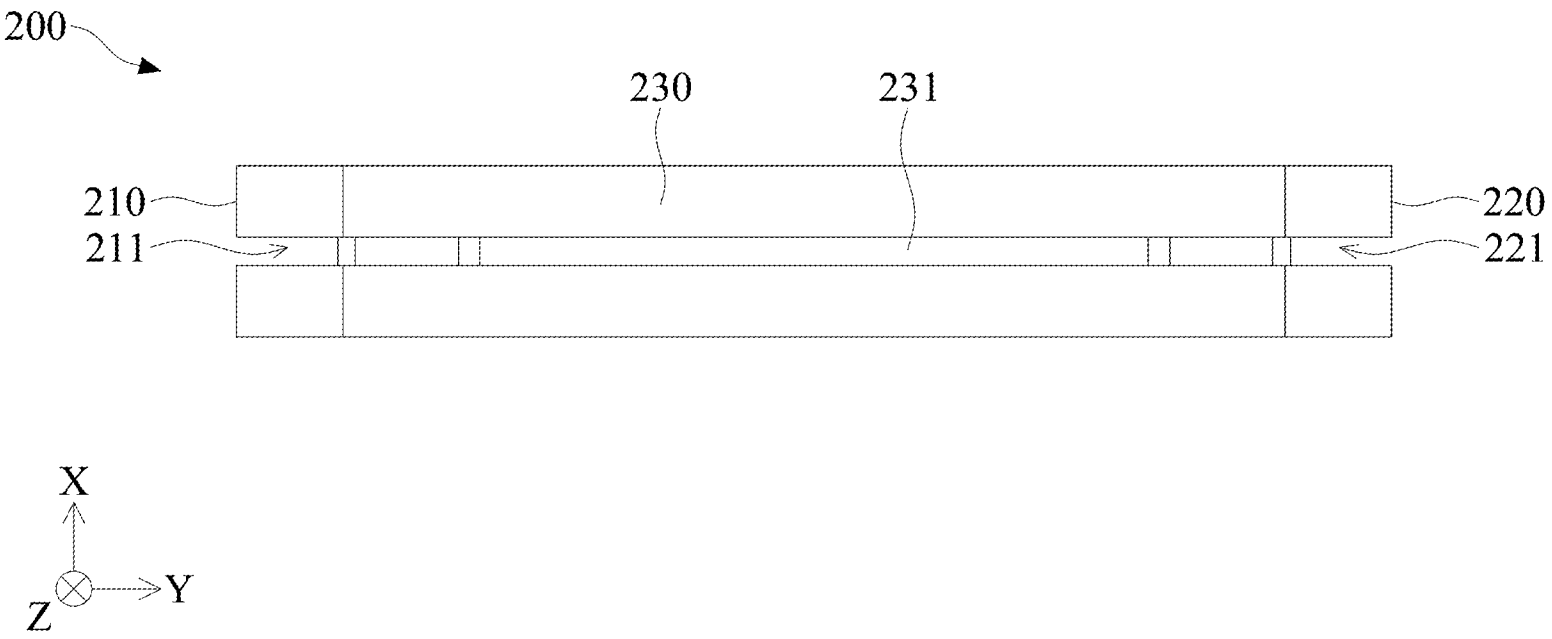
FIG. 5 is a bottom view of the plate according to an embodiment of the invention.

Referring to FIGS. 2, 4, and 5, the plate 200 has a first side 210, a second side 220, a bottom side 230, wherein the first side 210 is opposite the second side 220, and the bottom side 230 connects the first side 210 to the second side 220. Specifically, a first guiding slot 211, a second guiding slot 221, and the third guiding slot 231 are respectively formed on the first side 210, the second side 220, and the bottom side 230, and the first, second, and third guiding slots 211, 221, and 231 are communicated to each other. When the plate 200 is disposed on the housing 100, at least a portion of the lateral walls 120 is accommodated in the first, second, and third guiding slots 211, 221, and 231. Therefore, the plate 200 can be efficiently affixed to the housing 100 without other members (such as the screw of the glue), and the plate 200 can cover the opening 130.

In this embodiment, at least on through hole 240 is formed on the plate 200, wherein the through hole 240 is connected to a top side 250 of the plate 200 and communicated with the accommodating space. The plate 200 is made of a non-metal material, such as rubber or plastic. In some embodiments, the third guiding slot 231 on the plate 200 can be omitted.

Referring to FIG. 2, the cover 300 has an extending portion 310 extending toward the bottom plate 110, and the extending portion 310 can be joined to the housing 100 by hooks and latches. Therefore, the cover 300 can cover the accommodating space, and the accommodating space is in a closed state. The possibility of the foreign object (such as dust or liquid) entering the accommodating space can be reduced, and the failure of the electronic member 400 or the wireless coil 500 caused by the foreign object can be prevented. Moreover, when the cover 300 is joined to the housing 100, the top side 250 of the plate 200 can also be covered by the cover 300, so as to prevent the falling of the plate 200 when the light-emitting diode driver E reverses.

In this embodiment, the cover 300 and the housing 100 are made of metal, so as to increase the joint strength therebetween and the rigidity of the light-emitting diode driver E.

The electronic member 400 is disposed on the bottom plate 110 of the housing 100, accommodated in the accommodating space, and situated between the cover 300 and the bottom plate 110. For example, the electronic member 400 can include a circuit board 410, a capacitance or a resistance 420, and/or a transformer 430. The wireless coil 500 is also accommodated in the accommodating space, and situated between the cover 300 and the bottom plate 110. Furthermore, the wireless coil 500 is electrically connected to the electronic member 400 and adjacent to the plate 200. Since the plate 200 has non-metal material, the user can transmit the signal to the wireless coil 500 through the plate 200, and the purpose of wireless control can be achieved.

The wire W1 can pass through one of the lateral walls 120 of the housing 100, and electrically connect the electronic member 400 to the power device (not shown). The power from the power device can therefore transmit to the electronic member 400 via the wire W1. The wire protecting ring 600 is disposed on the aforementioned lateral wall 120 of the housing 100 and surrounds the wire W1, so as to prevent the wire W1 from breaking due to the bend.

One end of the wire W2 is electrically connected to the electronic member 400, and the other end of the wire W2 passes through the through hole 240 on the plate 200 and electrically connects the light-emitting diode module (not shown). After the power from the power device flows through the electronic member 400, it can be transmitted to the light-emitting diode module via the wire W2, so as to provide the required power of the light-emitting diode module. The electronic member 400 and the wireless coil 500 are electrically connected to each other via the wire W3, and the other end of the wire W3 passes through another through hole 240 on the plate 200 and electrically connects the aforementioned light-emitting diode module (not shown). When the wireless coil 500 receives the signal transmitted from the user, it can transmit a control signal to the light-emitting diode module via the wire W3, so as to control the light-emitting diode module (for example, turn on or turn off the light-emitting diode module).

Figure 6A:
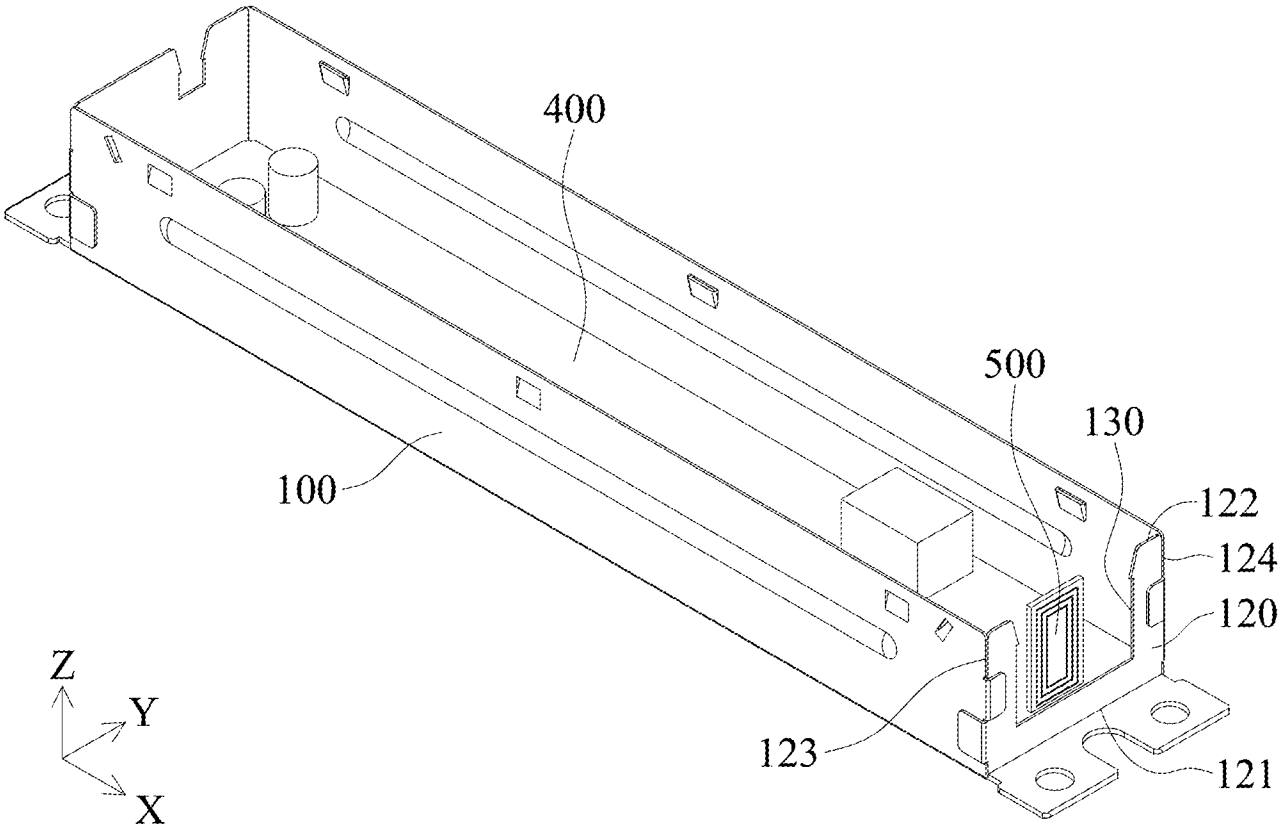
FIG. 6A is a schematic diagram of the housing, the electronic member, and the wireless coil according to an embodiment of the invention.

Owing to the aforementioned structure of the light-emitting diode driver E, the user can simplify the assembly step of the light-emitting diode driver E, and the need for a fastener (such as screw) can be avoided or reduced. The assembly method of the light-emitting diode driver E is discussed below. Referring to FIG. 6A, first, the user can affix the electronic member 400 and the wireless coil 500 to the bottom plate 110 of the housing 100. It should be noted that the wireless coil 500 is adjacent to the opening 130 of the housing 100.

Figure 6B:
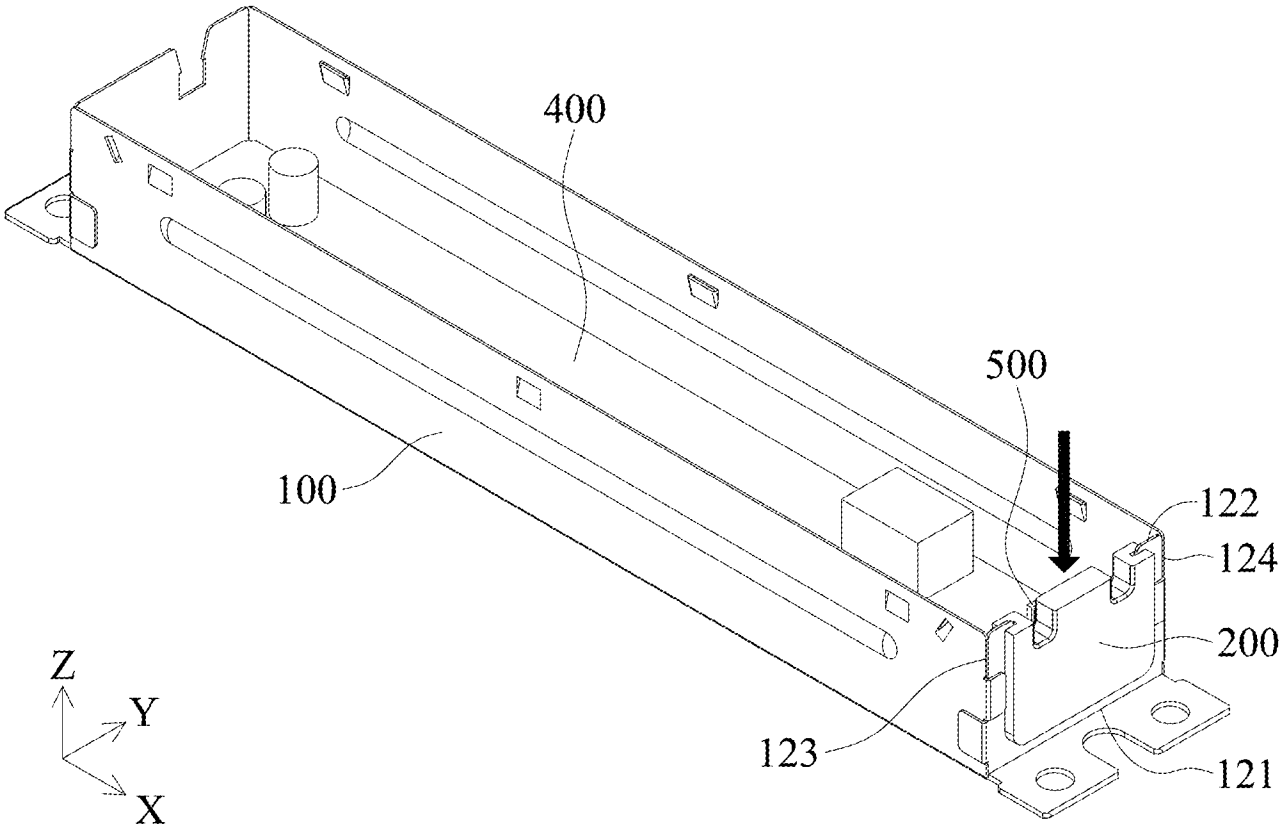
FIG. 6B is a schematic diagram of the housing, the plate, the electronic member, and the wireless coil according to an embodiment of the invention.
Figure 6C:
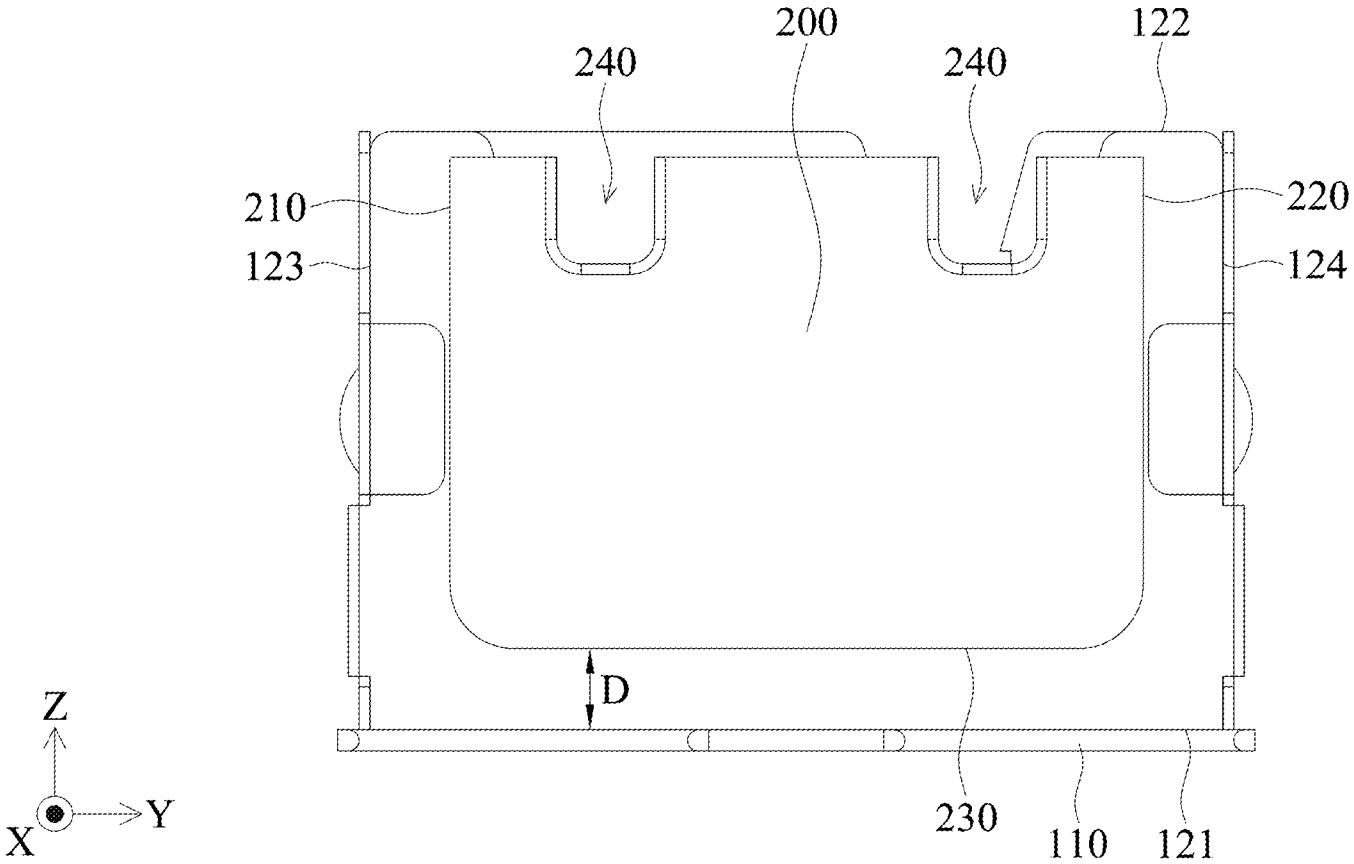
FIG. 6C is a front view of the housing and the plate according to an embodiment of the invention.

Second, as shown in FIG. 6B, the plate 200 can be disposed on the housing 100 and cover the opening 130. In particular, a portion of the lateral wall 120 having the opening 130 can enter the first guiding slot 211 and the second guiding slot 221. The plate 200 can be therefore guided and move to the bottom plate 110 along the Z-axis. When the bottom side 230 of the plate 200 contacts the lateral wall 120, a portion of the lateral wall 120 can enter the third guiding slot 231. Since the dimensions of the opening 130 is substantially the same as that of the plate 200, the bottom side 230 of the plate 200 can be adjacent to the bottom plate 110 of the housing 100 when the plate 200 is disposed on the housing 100, and the plate 200 does not protrude from the second end 122 of the lateral wall 120. As shown in FIG. 6C, in this embodiment, the distance D between the bottom side 230 of the plate 200 and the second end 122 of the lateral wall 120 is less than ⅙ of the distance between the first end 121 and the second end 122.

Since the plate 200 having the non-metal material provides a sufficient transmitting area, and the wireless coil 500 is adjacent to the plate 200, the signal transmitting of the wireless control can be improved.

Figure 6D:
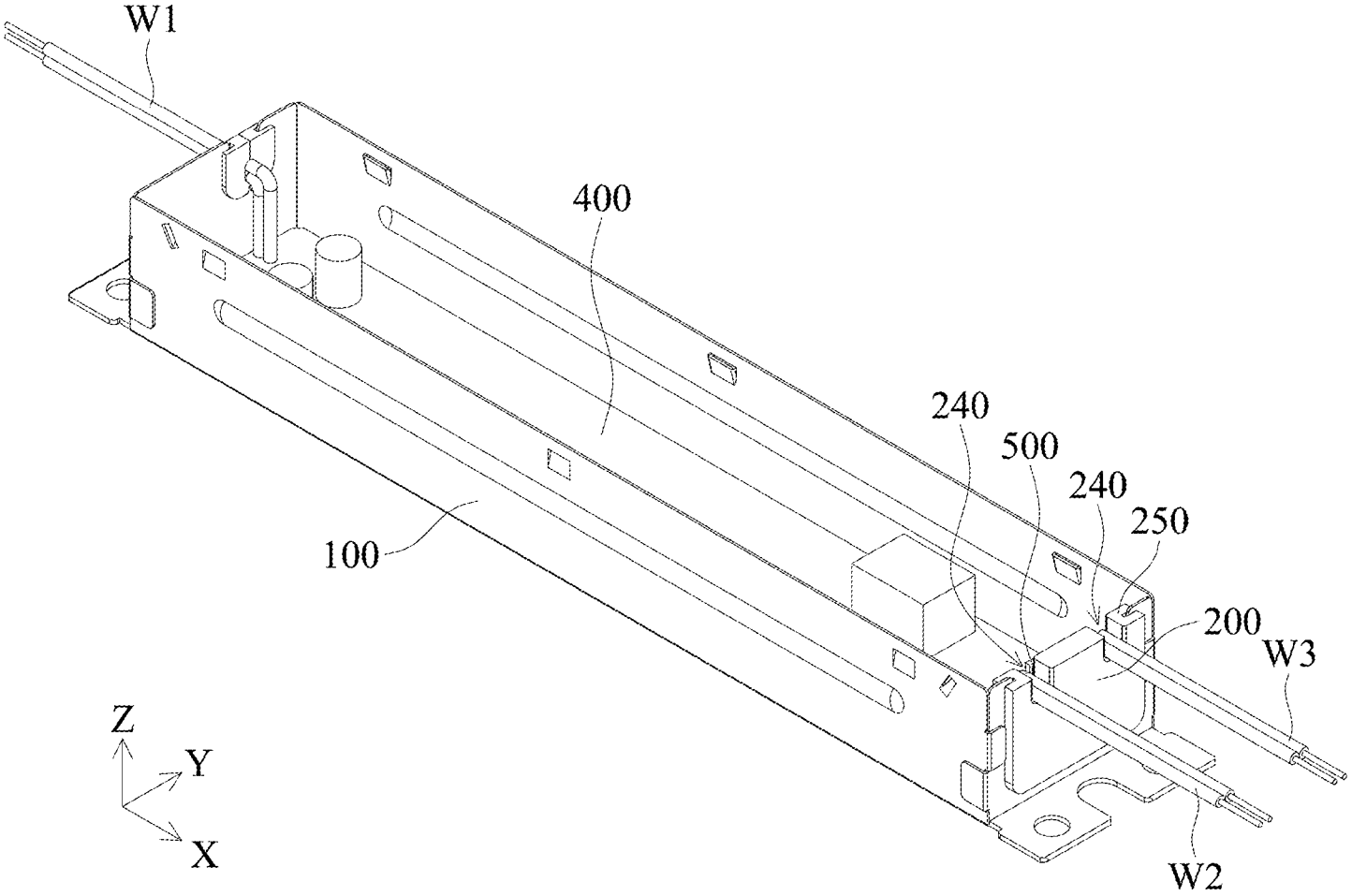
FIG. 6D is a schematic diagram of the housing, the plate, the electronic member, the wireless coil, and the wires according to an embodiment of the invention.

Next, as shown in FIG. 6D, the user can pass the wire W1 through the wire protecting ring 600, and dispose the wire protecting ring 600 on the lateral wall 120, wherein the wire W1 is electrically connected to the electronic member 400 and the power device. At the same time, the user can connect the wires W2 and W3 to the electronic member 400 and the wireless coil 500, and pass the wires W2 and W3 through the through holes 240 on the plate 200 to connect the light-emitting diode module. It should be noted that, since the through holes 240 are connected to the top side 250 of the plate 200, the user can put the wires W2 and W3 into the through hole 240 from the top side 250 directly.

Figure 6E:
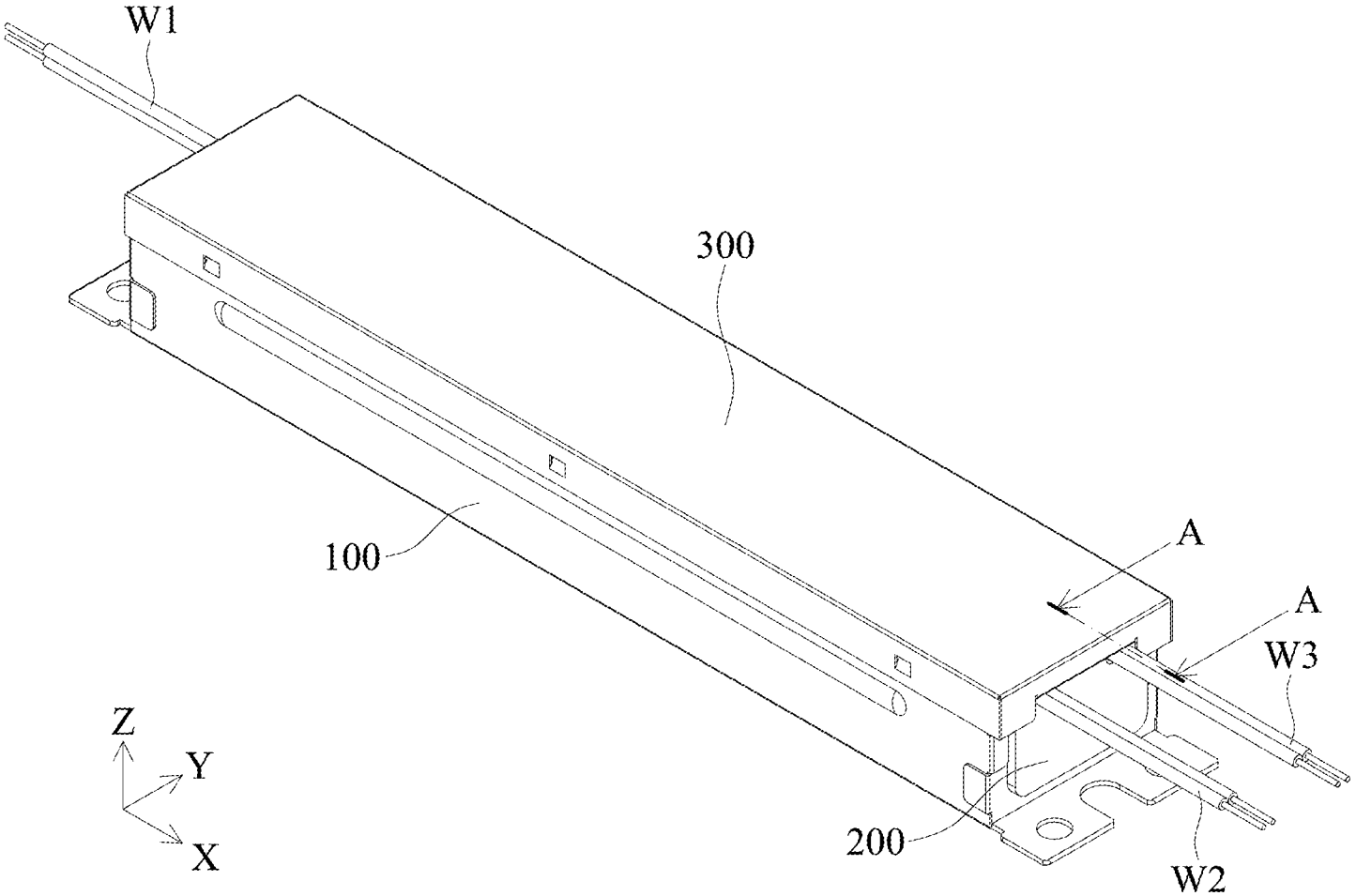
FIG. 6E is a schematic diagram of the light-emitting diode driver according to an embodiment of the invention.
Figure 6F:
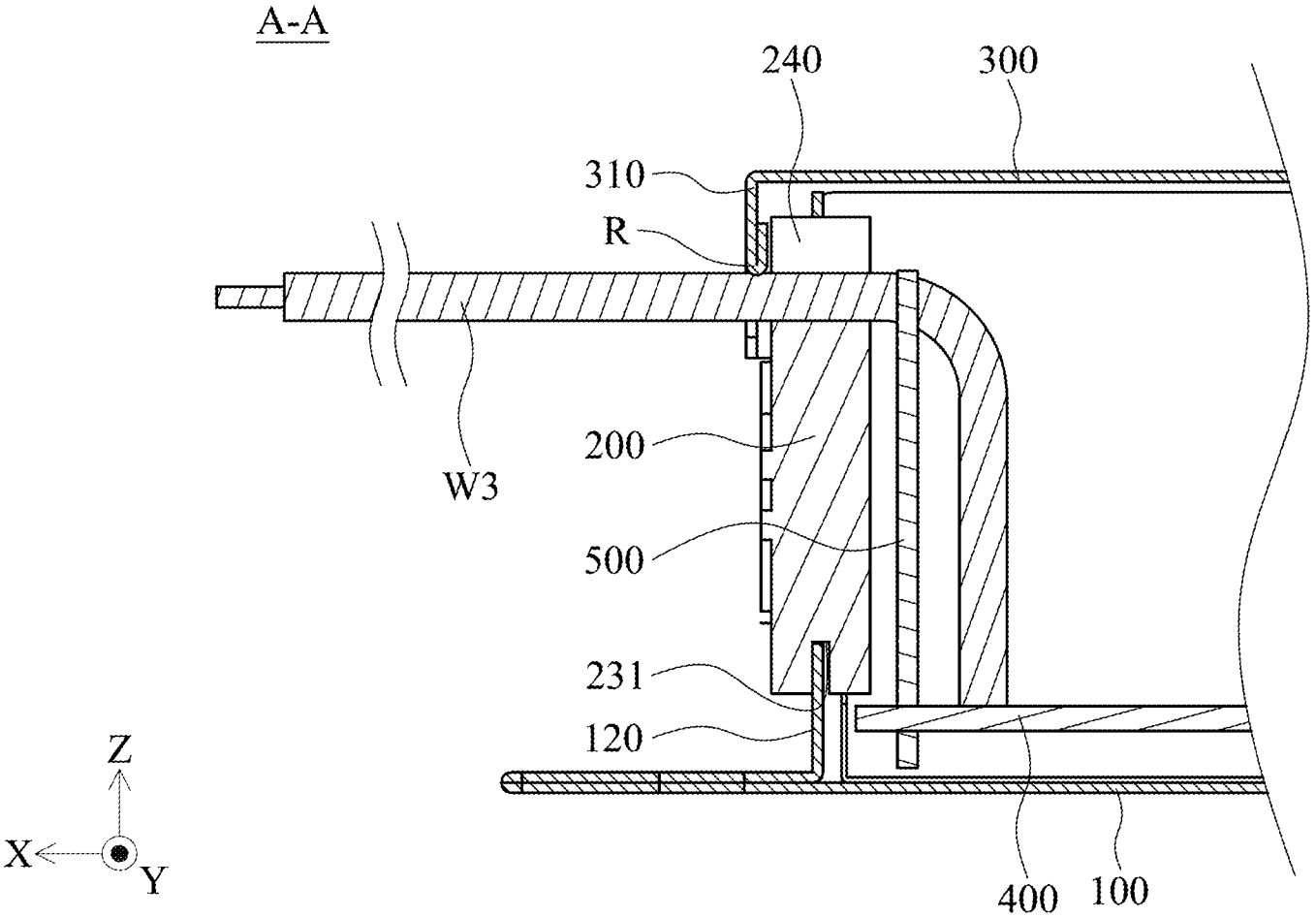
FIG. 6F is a cross-sectional view along the line A-A in FIG. 6E.

Finally, as shown in FIGS. 6E and 6F, the cover 300 can cover the accommodating space of the housing 100, and join to the housing 100 in a detachable manner (for example, by hooks and latches). Thus, the assembly of the light-emitting diode driver E is finished. It should be noted that the extending portion 310 of the cover 300 has a round corner R in the position adjacent to the wires W2 and W3 (for example, the round cover R can be formed by folding the board), so as to prevent the wires W2 and W3 from breaking due to the cutting by the extending portion 310.

In some embodiments, the cover 300 and the housing 100 can be joined together by another method, such as by adhering or affixing using a screw or rivet.

In summary, a light-emitting diode driver is provided, including a housing, a plate, a wireless coil, and at least one electronic member. The housing includes a lateral wall and a bottom plate connected to each other, and an opening is formed on the lateral wall. The plate is detachably connected to the housing, so as to cover the opening. The plate includes a first side, a first guiding slot, a second side, a second guiding slot, and a bottom side. The first side is opposite the second side, the first guiding slot and the second guiding slot are respectively formed on the first side and the second side, and the bottom side is adjacent to the bottom plate. At least a portion of the lateral wall is accommodated in the first and second guiding slots. The wireless coil is disposed in the housing and adjacent to the plate. The electronic member is disposed in the housing and electrically connected to the wireless coil. The housing and the plate are respectively made of metal and non-metal materials.

Although some embodiments of the present disclosure and their advantages have been described in detail, it should be understood that various changes, substitutions and alterations can be made herein without departing from the spirit and scope of the disclosure as defined by the appended claims. For example, it will be readily understood by those skilled in the art that many of the features, functions, processes, and materials described herein may be varied while remaining within the scope of the present disclosure. Moreover, the scope of the present application is not intended to be limited to the particular embodiments of the process, machine, manufacture, compositions of matter, means, methods and steps described in the specification. As one of ordinary skill in the art will readily appreciate from the disclosure of the present disclosure, processes, machines, manufacture, compositions of matter, means, methods, or steps, presently existing or later to be developed, that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps. Moreover, the scope of the appended claims should be accorded the broadest interpretation so as to encompass all such modifications and similar arrangements.

While the invention has been described by way of example and in terms of preferred embodiment, it should be understood that the invention is not limited thereto. On the contrary, it is intended to cover various modifications and similar arrangements (as would be apparent to those skilled in the art). Therefore, the scope of the appended claims should be accorded the broadest interpretation to encompass all such modifications and similar arrangements.

What is claimed is:

1. A light-emitting diode driver, comprising:

a housing, comprising a lateral wall and a bottom plate, wherein the lateral wall is connected to the bottom plate, and an opening is formed on the lateral wall;

a plate, detachably connected to the housing and covering the opening, comprising:

a first side;

a first guiding slot, formed on the first side, wherein a portion of the lateral wall is accommodated in the first guiding slot when the plate is connected to the housing;

a second side, opposite the first side;

a second guiding slot, formed on the second side, wherein a portion of the lateral wall is accommodated in the second guiding slot when the plate is connected to the housing; and a bottom side, adjacent to the bottom plate;

a wireless coil, disposed in the housing and adjacent to the plate; and at least one electronic member, disposed in the housing and electrically connected to the wireless coil, wherein the housing is made of metal materials, and the plate is made of non-metal materials.

2. The light-emitting diode driver as claimed in claim 1, wherein the plate further comprises a third guiding slot foil ied on the bottom side, and a portion of the lateral wall is accommodated in the third guiding slot when the plate is connected to the housing.

3. The light-emitting diode driver as claimed in claim 2, wherein the third guiding slot is communicated with the first guiding slot and the second guiding slot.

4. The light-emitting diode driver as claimed in claim 1, wherein the light-emitting diode driver further comprises a cover detachably connected to the lateral wall of the housing, wherein the wireless coil and the electronic member are disposed between the cover and the bottom plate.

5. The light-emitting diode driver as claimed in claim 4, wherein the cover comprises an extending portion extended toward the bottom plate, and the plate is disposed between the extending portion and the wireless coil.

6. The light-emitting diode driver as claimed in claim 1, wherein the light-emitting diode driver further comprises a wire, and the plate further comprises a through hole, wherein the wire passes through the through hole and connects to the wireless coil or the electronic member.

7. The light-emitting diode driver as claimed in claim 6, wherein the light-emitting diode driver further comprises a cover detachably connected to the lateral wall of the housing, and the cover comprises an extending portion extended toward the bottom plate, wherein the extending portion has a round corner adjacent to the wire.

8. The light-emitting diode driver as claimed in claim 1, wherein the opening and the lateral wall have a cross-sectional area, and the area of the opening occupies 80% of the cross-sectional area.

9. The light-emitting diode driver as claimed in claim 8, wherein the dimensions of the plate are substantially the same as the dimensions of the opening.

10. The light-emitting diode driver as claimed in claim 1, wherein the lateral wall has a first end and a second end, the first end is connected to the bottom plate, and the second end is opposite the first end, wherein the distance between the bottom side and the second end is less than ⅙ of the distance between the first end and the second end.

11. The light-emitting diode driver as claimed in claim 1, wherein the lateral wall has a first end and a second end, the first end is connected to the bottom plate, the second end is opposite the first end, and the plate does not protrude from the second end.

* * * * *